United States Patent [19]

Kay

[11] 4,018,266

[45] Apr. 19, 1977

[54] BUILDING FRESH AIR VENTILATOR SYSTEM

[75] Inventor: Herbert M. Kay, Waco, Tex.

[73] Assignee: Command-Aire Corporation, Waco, Tex.

[22] Filed: Apr. 30, 1975

[21] Appl. No.: 573,347

[52] U.S. Cl. ..... 165/12; 165/16; 165/48

[51] Int. Cl.[2] ..... F25B 29/00

[58] Field of Search ..... 165/12, 16, 26, 58, 165/59, 48, 17

[56] References Cited

UNITED STATES PATENTS

| | | | |
|---|---|---|---|
| 2,202,731 | 5/1940 | Crago | 165/12 |
| 2,401,560 | 6/1946 | Graham et al. | 165/17 |
| 2,886,955 | 5/1959 | Bauman | 165/48 |
| 3,252,508 | 5/1966 | Goettl | 165/48 |
| 3,882,928 | 5/1975 | Gazzo | 165/12 |
| 3,915,376 | 10/1975 | Attridge, Jr. et al. | 165/16 |

*Primary Examiner*—C. J. Husar
*Assistant Examiner*—Daniel J. O'Connor
*Attorney, Agent, or Firm*—James C. Fails

[57] ABSTRACT

A fresh air ventilator system for a building or the like having a conditioned air plenum and a return air aperture communicating interiorly of the building, respectively, for circulation of conditioned air within the building, characterized by a ventilator unit disposed in a weather-proof cabinet on a sealing roof curb on the roof of the building. The ventilator unit includes a fresh air inlet adapted to admit fresh air and exclude precipitation and having a fresh air damper for controlling the quantity of fresh air from zero to the maximum; an air circulating blower suitably connected to effect circulation of air through the building; an exhaust means for at least periodically exhausting a portion of the return air; a proportioning damper disposed at the return air aperture for proportioning the amount of return air, from zero to the maximum, fed to the circulating blower; and air conditioning means for conditioning the air to be circulated. Also disclosed are specific preferred structural embodiments, controls, modes and operations; for example, the fresh air inlets, the return air exhaust means, the disposition of the condenser passageway and fan with respect to the fresh air inlet, and the splitter arrangement of the proportioning damper between circulated air and exhaust.

8 Claims, 8 Drawing Figures

Fig. 2
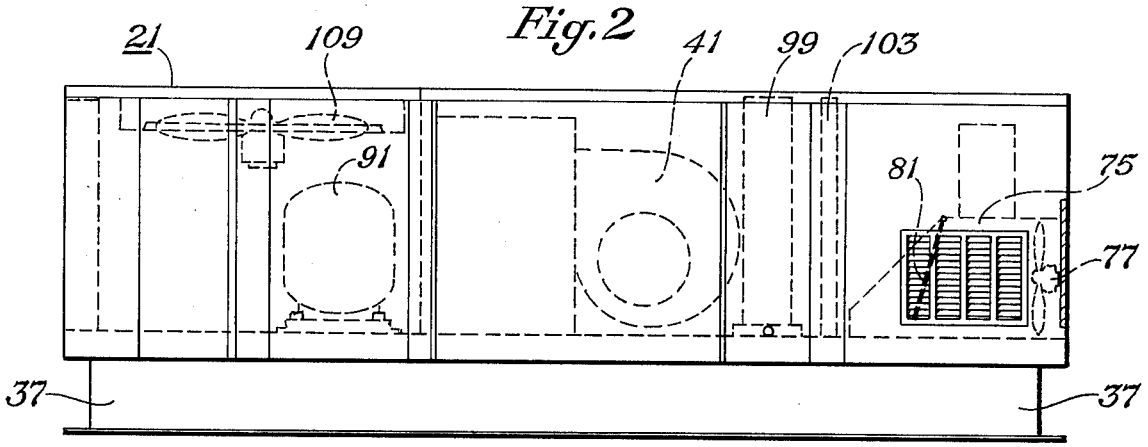
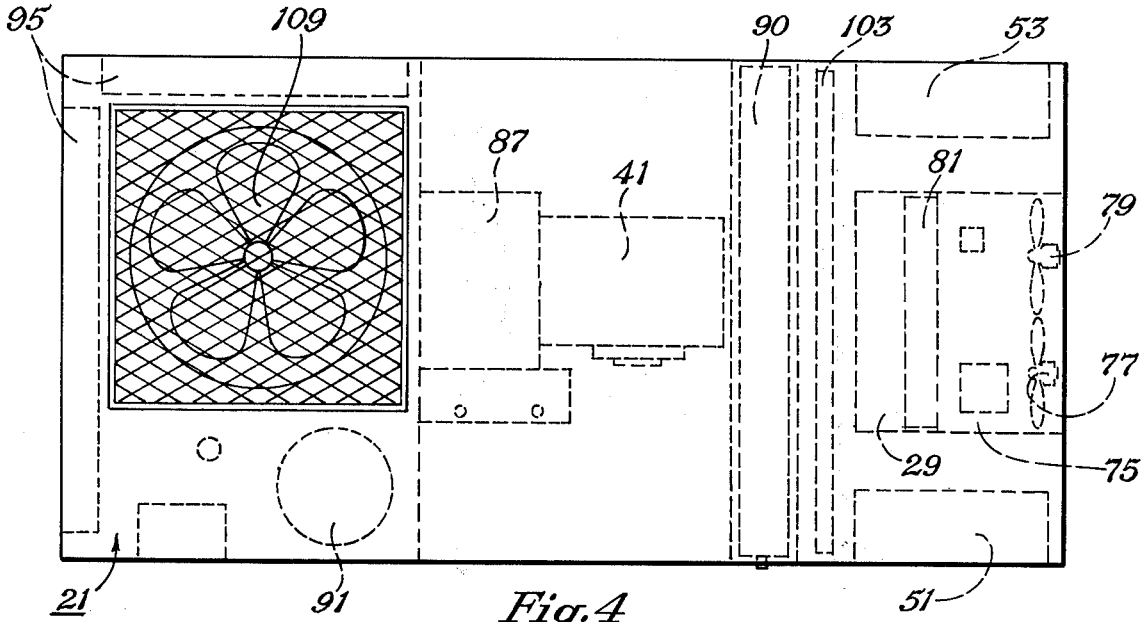
Fig. 4
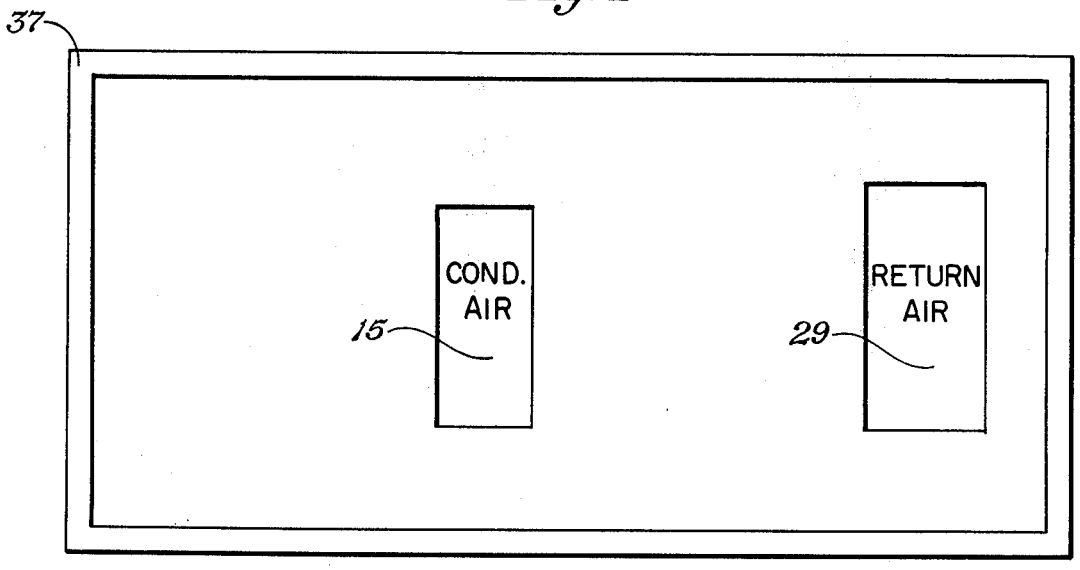
Fig. 5

Fig.3
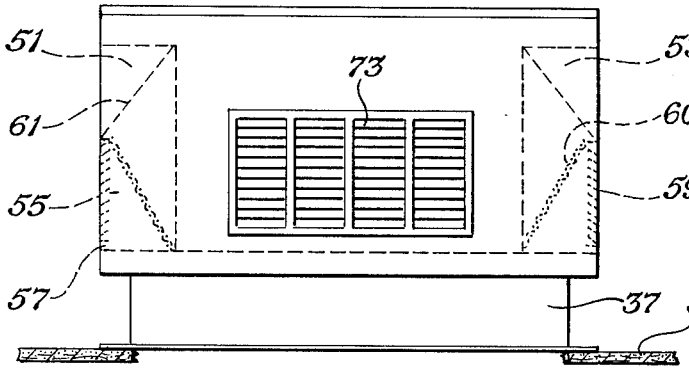
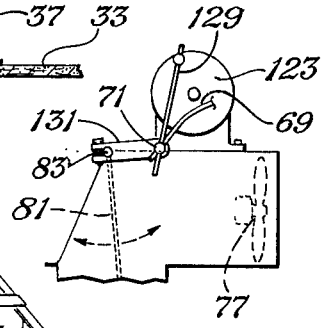
Fig.8
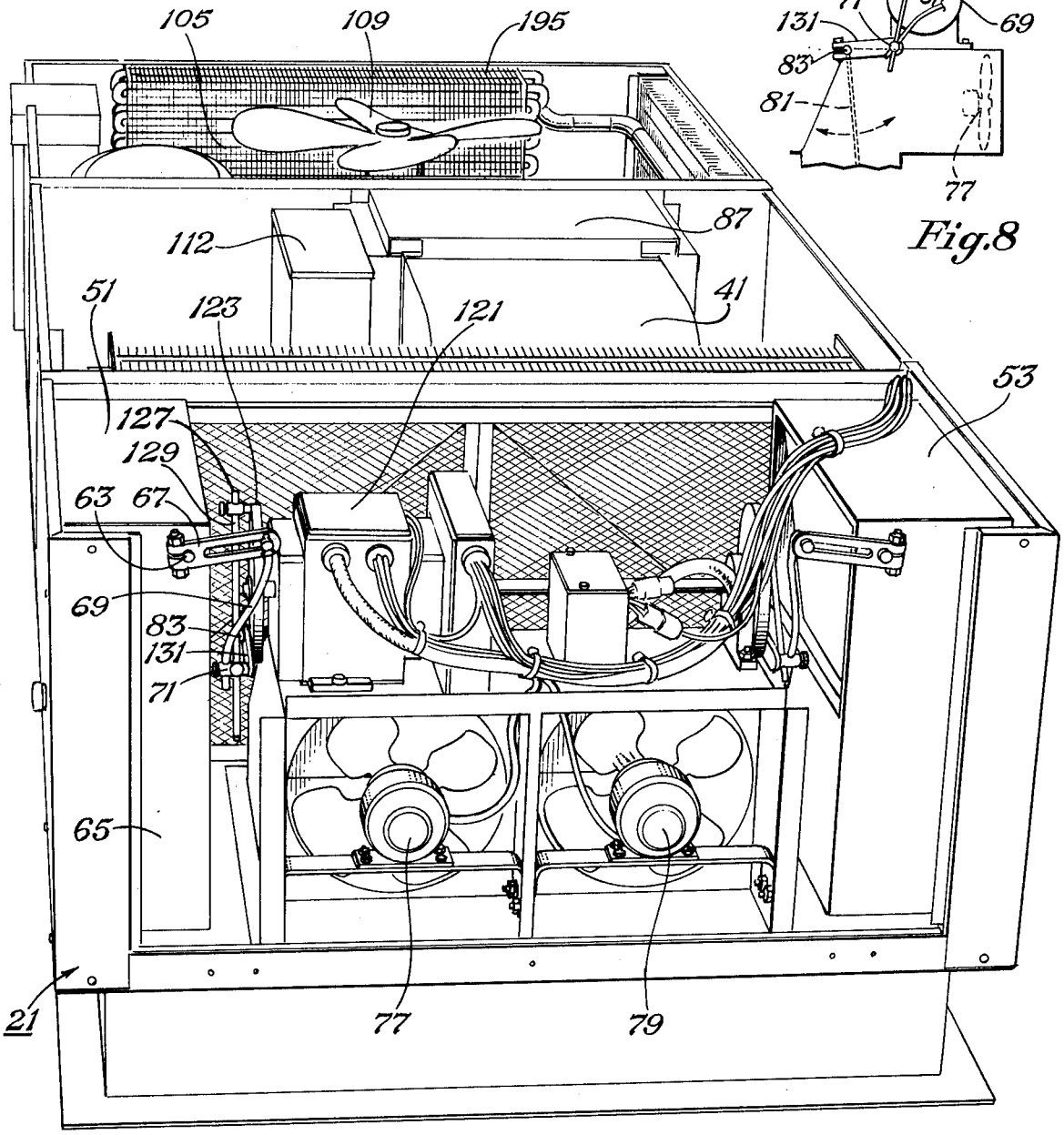
Fig.6

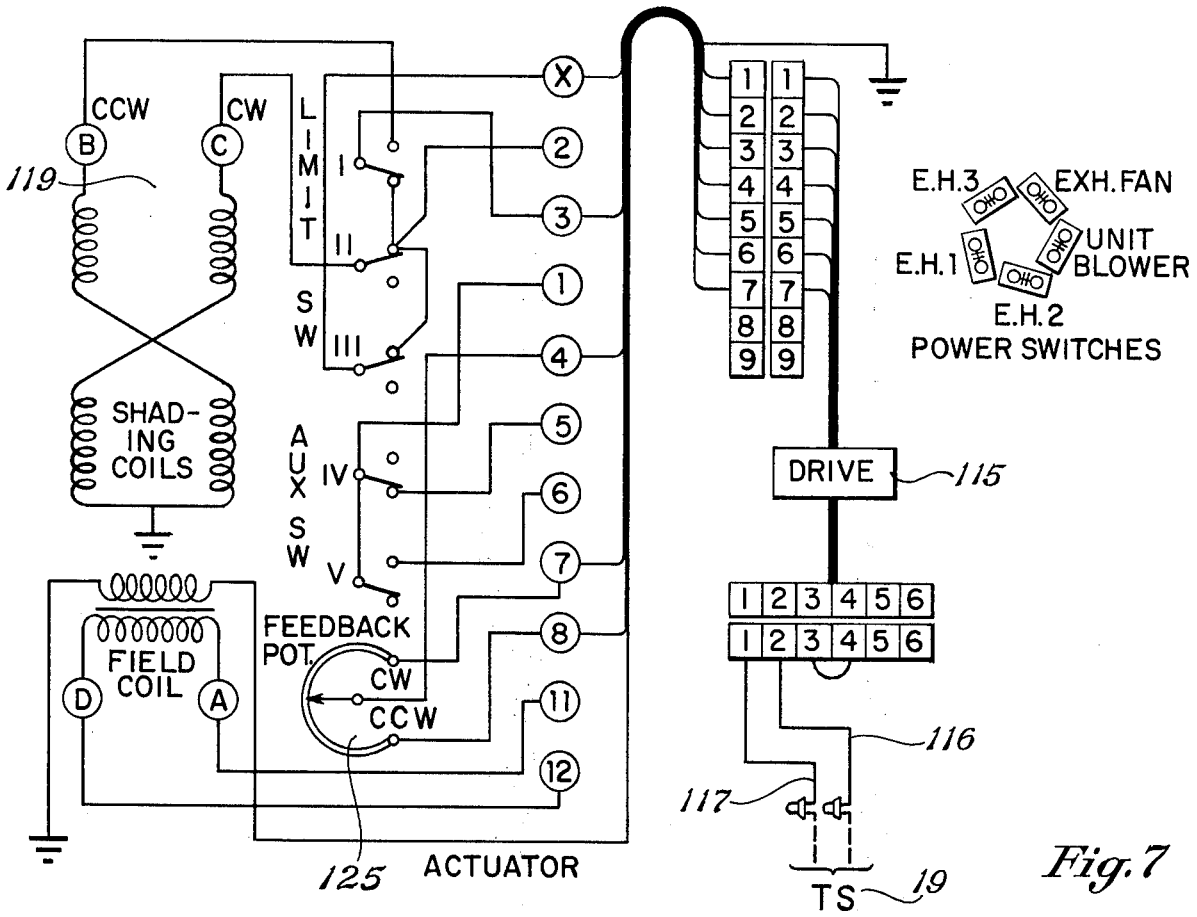
Fig. 7
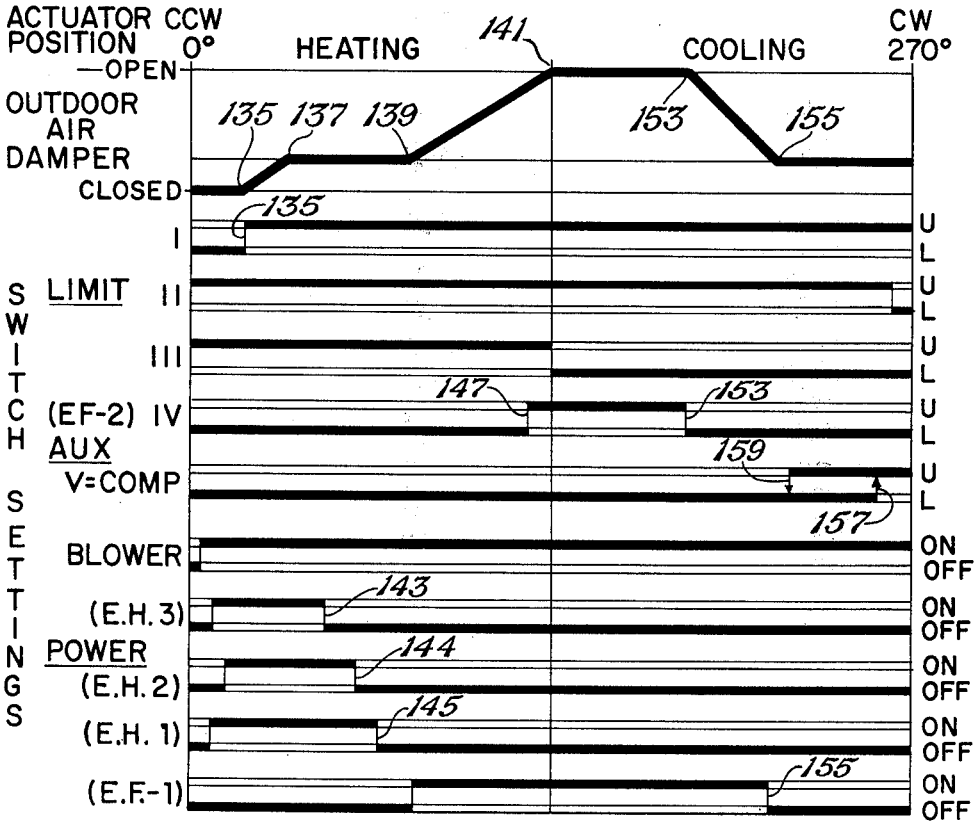

BUILDING FRESH AIR VENTILATOR SYSTEM

BACKGROUND OF THE INVENTION

1. Field of the Invention

This invention relates to fresh air ventilator systems for conditioning the air that is circulated within a building. More particularly, this invention relates to an air conditioning system for use in a building such as an educational plant, that requires a minimum amount of fresh air to be circulated when the building is occupied; in addition to the usual heating and cooling requirements for comfort.

2. Description of the Prior Art

The field of air conditioners for conditioning air to be circulated in buildings has been highly developed and the prior art has seen a wide variety of systems for this purpose. In certain types of buildings, such as educational plants, the requirements have been more stringent; frequently imposed by statute. For example, a minimum amount of fresh air is required to be circulated in the building to minimize the chance of accumulation of stale air or constitutents thereof that tend to cause inhalation difficulties, spread contagious diseases or incur an accident. Of the numerous prior art patents, the closest apparatus and system of which I am aware is disclosed in U.S. Pat. No. 3,831,395. In that patent, there is disclosed a unit for setting in a classroom or the like to obviate the therein delineated and implied disadvantages of the earlier art. Specifically, the earlier art had required altering the building; difficulty and loss of classroom time in installation and maintenance; the distraction and discomfort by operating noises; and the requirements of undue floor space necessarily withdrawn from teaching use. While the apparatus described in U.S. Pat. No. 3,831,395 was useful in minimizing some of the disadvantages, it still required installation adjacent an outside wall, occupying a portion of the classroom space; was visible from the classroom; and, though its noise level was low, could still be heard in the classroom. Because it required an outside wall, that apparatus was frequently emplaced over a window or the like; blocked out a portion of the view of the exterior; and interfered with the design of the architect.

In short, experience with the prior art has indicated that a most nearly ideal fresh air ventilator system would have the following features that have not been heretofore available in the prior art.

1. The ventilator unit should be disposed exteriorly of the building, such as exteriorly of the classroom, so as to avoid taking up valuable classroom floor space, eliminate noise in the room and give a better atmosphere for learning or working.

2. The ventilator unit should be in a weatherproof enclosure and should engage the building by a suitable sealing means that obviates difficulties with water coming in around ducts, plenums and the like.

3. The ventilator unit should have fresh air inlets that enable obtaining fresh air for circulation within the building without getting precipitation into the circulation system and without unsightly protuberances, hoods and the like that interfere with blending into a pleasing architectural scheme even when visible from outside the building.

4. The ventilator unit should have a proportioning damper means on the return air to form a part of the channel that comprises part of the exhaust means for exhausting stale air.

5. The ventilator system should conserve power; particularly in the cooling operation by utilizing fully the ambient cooling available. In doing so, the system should alleviate problems with changing the pressure inside the building, as by inlet or discharge blowers that have excess power that raise or lower the pressure in the building and that require more energy for operation than is necessary.

SUMMARY OF THE INVENTION

It is therefore an important object of this invention to provide one or more of the foregoing features not heretofore provided by the prior art and thereby obviate the deficiencies of the prior art methods and apparatus.

It is a specific object of this invention to provide an invention that has a plurality or all of the delineated features and obviates the disadvantages of the prior art.

With regard to the latter object, it will be seen that this invention, in specific embodiments, includes a ventilator unit that can be economically manufactured and installed without interruption of the use of the building and can be removed or repaired, similarly without interruption of the use of the building; and that isolates vibration and noise for a better working and learning atmosphere or the like inside the building.

Other objects of the present invention will become apparent from the following descriptive matter, particularly when taken together with the accompanying drawings.

BRIEF DESCRIPTION OF THE DRAWINGS

FIG. 2 is a side elevational view of a ventilator unit of FIG. 1.

FIG. 3 is an end view of the ventilator unit of FIG. 1.

FIG. 4 is a top view of the ventilator unit of FIG. 1.

FIG. 5 is a plan view of a sealing roof curb and openings for supply and return ducts for the ventilator unit of FIG. 1.

FIG. 6 is a perspective view of the ventilator unit of FIG. 1 with portions of the ventilator unit removed. to afford a view of the interior thereof.

FIG. 7 is a schematic view showing the operational sequence chart and the electrical schematic of the actuator and power switches for carrying out the operational sequences.

FIG. 8 is a partial side elevational view of the damper positioning means of FIG. 6.

DESCRIPTION OF PREFERRED EMBODIMENTS

Figure 1:
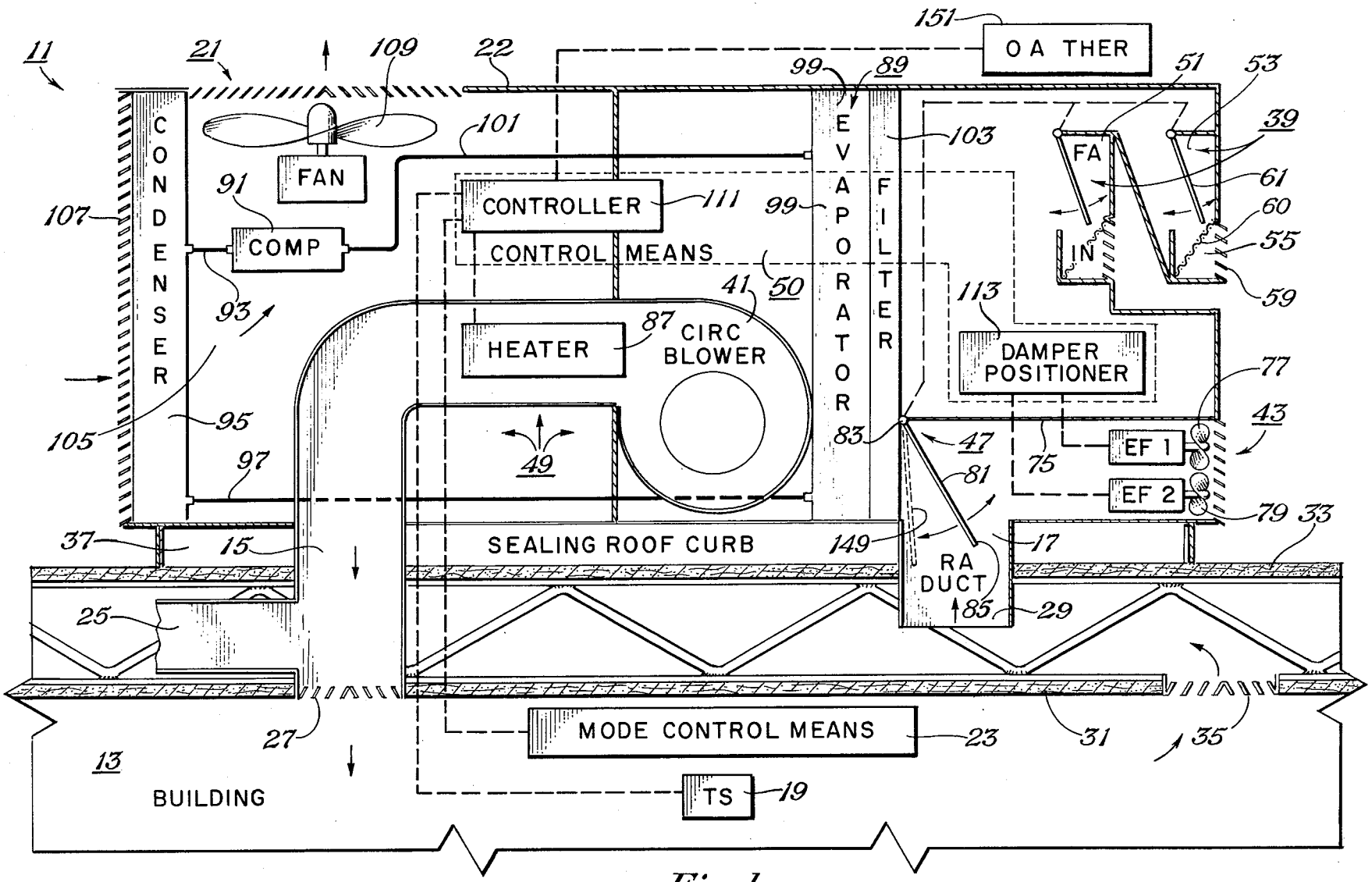
FIG. 1 is a schematic view of one embodiment of the fresh air ventilator system of this invention.

The following broad outline of steps followed in the method of operation affords insight into the interrelationships between some aspects of the invention and specific elements and subcombinations delineated in the apparatus hereinafter as is helpful in understanding the specific embodiments described hereinafter. In considering these steps, it should be borne in mind that the building may be any building in which a minimum proportion of fresh air is desired to be circulated, but the descriptive matter hereinafter is given primarily with respect to an educational plant having one or more school rooms or the like. In such plants, statutes frequently require a minimum predetermined proportion, such as 15 percent, of fresh air in the air being circulated when the classrooms are occupied.

In any event, the following broad method steps are employed in this invention. A flow diagram is given after the apparatus is delineated to tie the method steps into the specific apparatus in a more nearly comprehensive way to facilitate understanding.

The fresh air ventilator system is operated in either an unoccupied or occupied mode and a determination is made by the system, at least semi-automatically, as to the mode in which it is to operate. The term "at least semi-automatically" is employed herein to connote that operation may be semi-automatic or fully automatic. Illustrative of the semi-automatic operation is operation in response to the manual operation, such as a teacher turning on a light switch. Illustrative of the fully automatic operation is operation in response to a clocking unit. Both are discussed in more detail hereinafter. In the unoccupied mode, the return air is circulated through the building and conditioned as needed. Specifically, the air is heated in accordance with the demands reflected by a thermostat and this continues until a mode control means signals that the system is to be operated in the occupied mode. In the occupied mode, a mixture of return and fresh air is circulated, the fresh air being in a minimum predetermined proportion. From the response by the thermostat, the system automatically determines the type of conditioning that is needed for the air and enters into either a heating operation or cooling operation.

In the heating operation, heat is added to maintain the preset temperature, or the temperature set on the thermostat. The heating may continue until the mode control means signals a return to the unoccupied mode, as at the end of a school day. Ordinarily, however, the system will reflect heat added by the students or operating systems such that it will automatically change from a heating operation to a cooling operation sometime during the day. In the cooling operation, the outside air, or fresh air, is circulated in increasing proportion to try to maintain the preset temperature. When a first predetermined proportion; for example, from 40 to 50 percent of the air is fresh air, a first exhaust fan is energized in order to avoid difficulties with pressurization of the building. At a second proportion of fresh air; for example, from 80 to 90 percent of fresh air, a second exhaust fan is energized to again keep the proper pressure balance. (The advantages of the staged exhaust fan operation are set forth hereinafter.) The system automatically continues to operate in the outside air cooling operation as long as the outside air is less than a first predetermined temperature. The first predetermined temperature is ordinarily in the range of 50°–65°; for example, about 55° F.

In the event that the outside air cooling is inadequate and the temperature on the thermostat rises above the preset temperature and if the outside air is above the first predetermined temperature, a heat removal operation is begun. In the heat removal operation, only a minimum proportion of fresh air is admixed with return air and circulated. The exhaust fans are deenergized and auxiliarly cooling is energized to cool in accordance with demands by the thermostat. This mode of operation ordinarily continues until the mode control means signals a return to the unoccupied mode. In the event, however, that te outside air falls below the first predetermined temperature, the system automatically returns to the outside air cooling operation.

When the mode control means signals return to the unoccupied mode, that mode of operation is again begun.

One embodiment of this invention is illustrated in FIGS. 1–7. Referring to FIG. 1, the fresh air ventilator system 11 is illustrated to air condition building 13 and comprises a conditioned air plenum 15; a return air aperture 17; a thermostat 19 and a ventilator unit 21. As illustrated, the fresh air ventilator system 11 also includes a mode control means 23 for controlling the mode in which the ventilator system 11 will be operated.

As indicated hereinbefore, the building 13 may comprise any building requiring fresh air to be circulated for a reason; such as, children in a school room. The building 13 may comprise a single classroom; or a complex, with or without partitions for flexibility in team teaching and the like, having a plurality of air circulating vents. The unit of this invention is particularly advantages for operating in modern schools in which a large area is provided for flexibility of operating a plurality of different learning groups.

The conditioned air plenum 15 ordinarily includes one or more distribution plenums 25 that terminate in respective vents 27 for distributing the conditioned air as desired in the building 13. These plenums may comprise any of the conventional distribution ducts or the like; such as, those formed from sheet metal, plastic, or other materials. If desired, of course, the plenums may comprise passageways in the building structure itself; such as, between walls, above ceilings, or beneath floors.

The return air aperture 17 will oridinarily represent the terminal end of suitable passageways such as return air duct 29. The return air duct may comprise a plurality of ducts distributed throughout the building. Frequently, however, it is advantageous to employ passageways in the building itself as the return air ducts. As illustrated, the space above the ceiling 31 and below the roof 33, is employed as a return air duct. Suitable vents, such as vent 35, may be employed for the return air. As described hereinbefore with respect to the conditioned air plenum 15, the return air ducts may comprise any of the materials or any of the enclosed passageways that are conventionally employed in buildings 13.

Both the conditioned air plenum 15 and the return air aperture 17 communicate interiorly of the building for respectively distributing air to and returning air from within the building as necessary to obtain proper circulation of conditioned air within the building to maintain a preset temperature on the thermostat 19. FIG. 5 illustrates respective apertures for the conditioned air plenum 15 and the return air duct 29.

The thermostat 19 may comprise any of the conventionally employed thermostats, as long as it is compatible with the control means that is employed in the ventilator unit, as described hereinafter. In the illustrated embodiment, the thermostat 19 is a proportioning thermostat. Specifically, thermostat 19 emits a voltage that is directional with respect to a midpoint voltage to indicate the direction of the temperature with respect to a preset temperature, or the temperature set onto the thermostat. If the temperature is below the preset temperature, the thermostat emits a voltage that is different from the midpoint voltage; for example, below the midpoint voltage. Conversely, if the temperature is above the present temperature, the thermostat emits a voltage that is in the opposite direction from the preset temperature; for example, above the midpoint voltage. From the voltages, the system decides the type of conditioning to be employed in the ventilator unit 21.

The ventilator unit 21 is disposed on the roof 33 of the building 13 and connected with the conditioned air plenum 15 and the return air aperture 17. Specifically, the ventilator unit 21 rests on a sealing roof curb 37.

As can be seen in FIG. 1 and 3, the sealing roof curb is a suitably shaped structure that surrounds the ducts, plenums and apertures and that rigidly holds the ventilator above any potential water level on the roof; yet, curbs, or prevents entrance of, any water interiorly of the plenums, ducts or building. Typical of a suitable shape is the illustrative curb formed by the sealing, solid, rectangular member around the ducts, plenums and apertures. Preferably, the sealing roof curb 37 is manufactured at the factory so as to sealingly engage the roof 33 and fastened to the bottom of the ventilator unit 21 so as to preclude entrance of water thereinto. As illustrated, the sealing roof curb 37 is sealed to the roof 33 by way of tar or the like such that great care need no be taken to seal about the conditioned air plenum 15 and the return air duct 29; where there might otherwise be problems effecting a good seal with the contraction and expansion of the respective conditioned air plenum 15 and return air duct 29.

The ventilator unit 21 is encased in a weatherproof cabinet 22. Whereas stainless steel, aluminum, plastic, or other weather resistant material may be employed for making the cabinet 22, is is economically advantageous to provide light gauge metal and finish it is a baked enamel in a color that blends with the roof and makes a pleasing structure that has no protruding appurtenances, ducts or exhaust hoods.

The ventilator unit 21 includes one or more fresh air inlets 39 (F A IN); an air circulating blower 41 (CIRC Blower); exhaust means 43 for at least periodically exhausting a portion of the return air; a proportioning damper means 47 for proportioning the amount of return air circulated; an air conditioning means 49 for conditioning the air to be circulated; and a control means 50 for controlling operation of respective elements of the ventilator unit 21.

As illustrated, the fresh air inlet 39 comprises two fresh air inlet boxes 51 and 53 disposed respectively on each side of the ventilator unit 21, FIGS. 1, 3 and 4. Each fresh air inlet box has a chamber 55 into which incoming air initially flows. The chamber 55 is adapted to trap out precipitation and has a drain 57, FIG. 3, for draining the precipitation onto the roof of the building exteriorly of the roof curb 37. Any other suitable means can be employed for draining the precipitation back exteriorly of the ventilator unit 21, as desired. As illustrated, each fresh air inlet box has vanes 59 and a screen 60 for preventing entry into the building of precipitation, insects and the like. The incoming air deposits any precipitation via (1) the screem 60 and (2) the direction and velocity change in the chamber 55. A fresh air damper 61 is disposed at the upper portion of the fresh air inlet box. The respective chambers have an elongate configuration such that the respective fresh air inlet boxes are adapted to be intergrated into the ventilator unit and conform to the linear external lines of the ventilator unit for architecturally pleasing profiles and appearances. Specifically, the fresh air inlet boxes have rectangular cross sectional shapes that conform with the rectangular cross sectional shape of the ventilator unit illustrated.

Each of the fresh air dampers 61 is adapted to be set in a respective position so as to admit a predetermined amount of fresh air. Consequently, in combination with the position of a return air proportioning damper means, as described in more detail hereinafter, a proportion of fresh air is admixed into the air being circulated in the building. Specifically, the fresh air dampers 61 are pivotally mounted on shaft 63, FIG. 6, which is journalled in the housing 65. Lever arms 67 are fixedly connected with the protruding ends of the shafts 63, as by a bolt clamping a bifurcated end, so as to rotate in unison therewith and enable positioning the respective fresh air dampers 61. Suitable linkage 69 connects the lever arm 67 with a master link 71 that enables correlating the position of the fresh air damper 61n with respect to the return air damper. Preferably, the fresh air inlet boxes 51 and 53 are constructed of metal, such as galvanized steel, aluminum, or the like; although plastic or other conventional materials of construction may be employed if desired. In any event, the fresh air is allowed to enter into the admix with the return air to form a mixture that is conditioned and circulated through the building by the conditioned air blower 41.

The conditioned air blower 41 may comprise any of the conventional powered blowers employed in this art. Preferably, a squirrel cage type blower that is designed to deliver the desired cubic feet per minute of air is employed and driven by a motor. The motor may be any conventional motor and may drive the blower directly or indirectly, at single or multiply-variable speeds.

The exhaust means 43 communicates exteriorly of the ventilator unit by vanes 73, FIG. 3. The exhaust means 43 includes suitable exhaust duct 75, FIGS. 1, 2 and 4, that terminates adjacent the proportioning damper means 47 interiorly of the ventilator unit 21. As illustrated, the exhaust means 43 includes first exhaust fan 77, FIG. 4, (EF 1, FIGS. 1 and 7) and second exhaust fan 79 (EF 2). Each of the exhaust fans are driven by an appropriately sized electric motor affording direct, economical drive. Appropriate electrical connections (not shown) are afforded between the exhaust fans and the control means in order to operate as described hereinafter. The electrical connections may be made by any electrician and do not need to be embellished herein. It is sufficient to note that the exhaust fans are operable in successive stages array and are responsively connected with the control means 50 so a to handle exhaust of the proportion of the return air directed to the exhaust means by the proportioning damper means 47.

The proportioning damper means 47 is disposed at the return air aperture 17 for proportioning the amount of the return air; from zero to maximum, fed to the circulating blower. The proportioning damper means includes a return air damper 81 that coacts with the exhaust duct 75 to direct the remaining return air through the exhaust means 43. As illustrated, the return air damper 81 is fixedly connected with shaft 83 so as to rotate in unison therewith for pivoting and positioning the outer end 85 at the desired position to correctly proportion the return air being circulated with respect to the portion being exhausted. As illustrated, the free end 85 is located below the shaft 83; and traverses the return air aperture 17 for correctly proportioning the return air in the respective directions. The damper 81 may be formed of any material that is adapted to the rectangular planar construction and has sufficient rigidity to eliminate vibrations and the like. As illustrated, the damper 81 is formed of metal; such as, galvanized steel, or aluminum; although plastic and other materials can be employed if desired. The illustrated return air damper 81 traverses laterally across the return air duct 29, FIG. 2 and 4, as well as the exhaust duct 75, both of which have the same rectangular cross sectional shapes so as to enable operation throughout the traverse of the damper 81 without binding.

To condition the portion of the return air and the incoming fresh air, if any, the air conditioning means 49 includes a heater 87 and an air cooling unit 89. The heater 87 comprises multiple rows and columns of heating coils that are disposed in contact with air being circulated by the circulating blower 41 for most efficient heating of the air. Such heaters are commercially available and there is no need of further encumbering this application with conventionally known information. The air cooling unit 89 is disposed in the ventilator unit within the weatherproof cabinet 22. The illustrated air cooling unit is a mechanical refrigeration unit circulating a refrigerant through a conventional cycle. Such mechanical air conditioning units are well known in the art and do not need to be described in detail herein. It is sufficient to note that they include the elements and subassemblies of a compressor 91 for compressing the refrigerant gas and connected via conduit 93 with condenser 95. Thus, as in a conventional refrigerant cycle, the high pressure gas is condensed to a liquid by removal of heat by way of the condenser. The removal of heat is effected by passing of ambient air over the condenser. The condenser is, in turn, connected via conduit 97 with the evaporator 99 for evaporating the condensed liquid refrigerant and simultaneously removing heat from the air being circulated past the evaporator 99. The evaporator 99 is connected with the compressor via conduit 101 for conveying the refrigerant gas to the compressor to repeat the cycle. As is implicit from the foregoing, the evaporator is interposed in the ventilator unit in contact with the air beng circulated by the circulating blower 41. As illustrated, the evaporator 99 is upstream of the suction, or intake, side of the circulating blower 41 for most efficient operation.

To protect the evaporator 99 from becoming clogged with impurities in the air being circulating, a filter 103 is employed upstream of the evaporator. The filter 103 may take any of the desired forms.

As is well recognized in the art, the number of rows of coils and fins in the respective condenser and evaporator units will be designed for the heat to be removed from the air being circulated in the building in accordance with the specifications of the American Society for Heating, Refrigerating and Air Conditioning Engineers (ASHRAE). Moreover, suitable safety controls with liquid accumulators and liquid level controls may be employed as desired for safety. These liquid accumulators and safety controls are well known in the art, but are frequently not employed in less expensive units.

The ambient air is flowed past the condenser 95, for condensing the liquid, through a condenser air flow passageway 105. Suitable screens or vanes 107 may be provided upstream of the condenser to prevent fouling the condenser by leaves, trash, paper, or the like. A motor-driven condenser fan 109 is provided for forced circulation of ambinet air past the condenser 95. It is an important facet of this invention that the air that has been heated by circulation past the condenser be directed upwardly and away from the ventilator unit 21. It is also important to the efficiency of this unit that the condenser air flow passageway 105 and the condenser fan 109 be so disposed as to minimize the flow of hot air to the fresh air inlet 39. Specifically, the condenser air flow passageway 105, FIGS. 1 and 6, is located, as is the condenser fan 109, at the opposite end of the ventilator unit 21 from the fresh air inlet boxes 51 and 53. Moreover, the condenser fan is directed upwardly to increase the tendency of the hot air to flow upwardly and away from the fresh air inlet 39. This enables the unit to operate most efficiently, responsive to the control means 50.

The control means 50 includes a controller 111 and a damper positioner 113. The controller 111 includes a control box 112, FIG. 6, a conventional proportioning controller, such as a Barber-Coleman CP-8371 solid state drive 115, FIG. 7. As illustrated in FIG. 7, the thermostat 19 is connected to the solid state drive 115 of the controller 111 by suitable conductors 116 and 117. The drive unit 115 is then connected with suitable coils 119 of a driving motor 121, FIG. 6. The motor positions a disc 123 having respective cams and switches disposed thereabout for effecting the operations illustrated in FIG. 7 and described hereinafter.

The interconnection of the respective elements is illustrated in FIG. 7, as are the location of the power switches in order to effect the sequence described in the sequence chart thereof. The motor 121 and the disc 123 form the actuator portion of FIG. 7. Switch I is the mode control means, such as the light switch or clock controlled switch.

Switch III is lock out switch that prevents rotation of the disc part the heating cycle as described in more detail herein. Switches IV and V are, as illustrated on the sequence charts, the exhaust fan (E.F.—2) and the compressor (COMP). As illustrated, the motor and respective elements are electrically connected with a source of 220 volt alternating current. Suitable starting capacitors and the like are employed in accordance with conventional practice. The respective directions of rotation of the disc 123 and the motor 121 are indicated as clockwise (CW) and counterclockwise (CCW). The major portion of the control circuit and the sequence of events is in accordance with the standard ASHRAE II cycle, as will become apparent from the descriptive matter hereinafter. The major points of difference are the inclusion of the multiple exhaust fans and their respective switches associated with the motor 121 and the disc 123. As in the conventional cycle, the control means 50 controls the operation of the circulating blower 41, the heater 87 and the air cooling unit 89 responsive to interconnection with the thermostat 19. The disc 123 also has a feedback potentiometer 125, FIG. 7, to correctly position the disc responsive to the control signal and to stop motion upon the obtention of a null point in accordance with conventional control circuits.

The disc 123 has a master link bracket 127, FIG. 6, that is connected via suitable linkage 129 with the master link 71 that is connected with the linkage 69 of the fresh air inlet 39. The master link 71 is also connected with a lever arm 131 that is fixedly connected with the shaft 83 of the return air damper 81, FIGS. 1, 6 and 8. Thus, positioning of the disc 123 mechanically effects proper positioning of both the fresh air dampers 61 and the return air damper 81, as well as electrically effecting the operation of the other elements as described hereinafter.

The mode control means 23 may comprise suitable means, such as an electric light switch that is turned on by the teacher to signal the beginning of the day when she and the students begin arriving. It is connected to suitable relays to limit degrees of operation of the control means 50; specifically, the rotation of the disc 123. This type control system is relatively standard in the air conditioning art, since it allows positioning of suitable switches and cams on the disc to effect the various cycles of operation. If desired, a clock may be operated as to turn on and off the switch on week days and serve as the mode control means.

In operation, the respective elements and subassemblies operate to effect the method shown in the following flow chart.

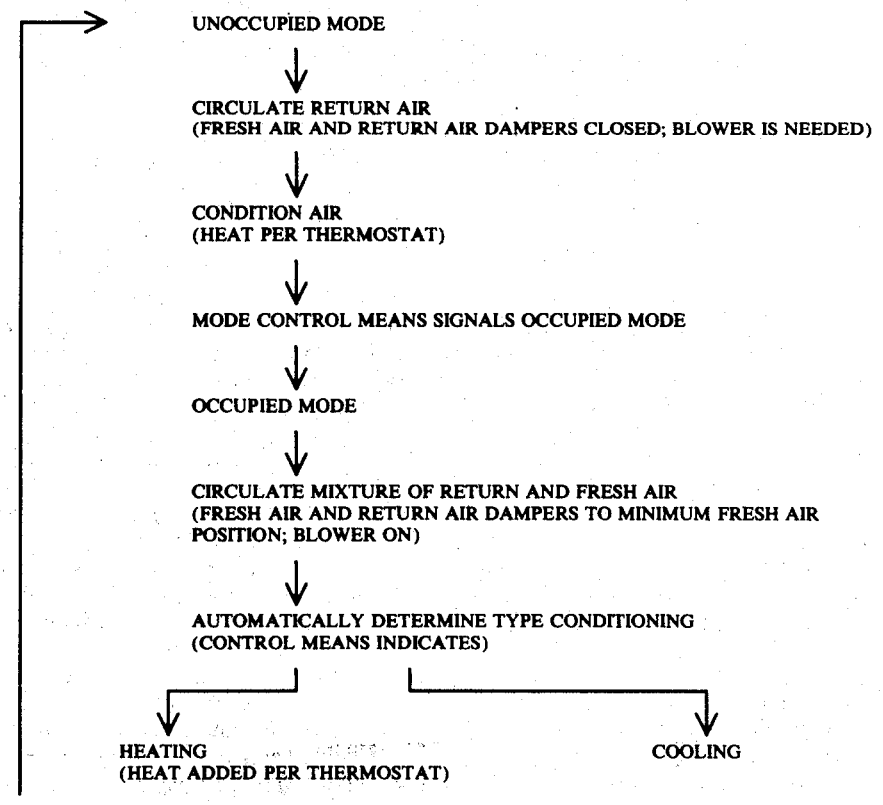

-continued

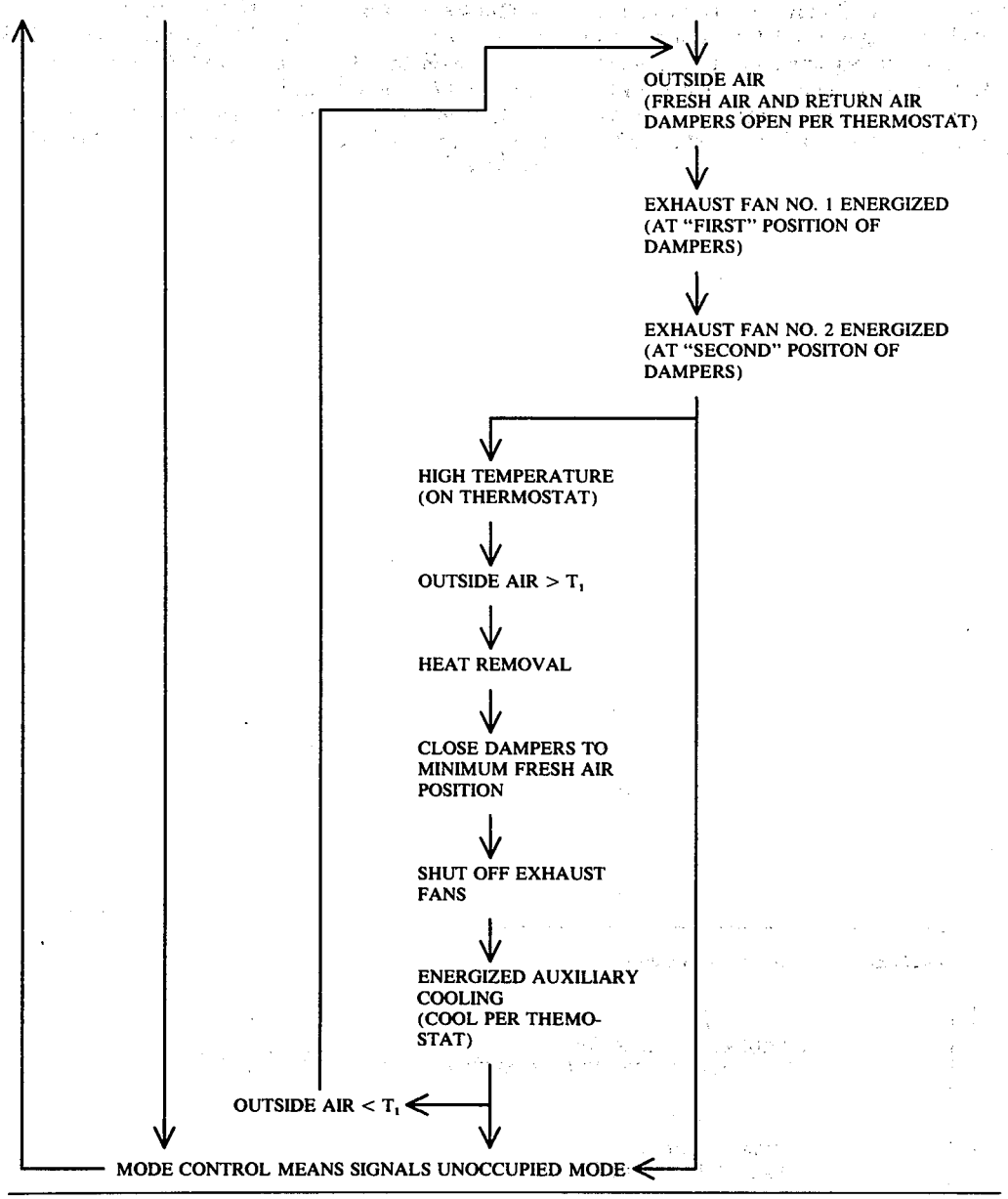

Referring to the flow diagram and FIGS. 1–7, particularly FIG. 7, the unit operates during the night or when the building is unoccupied by students in the unoccupied mode. In the unoccupied mode, disc 123 is locked by a relay (not shown) of the mode control means 23 to prevent greater rotation than position 135; for example, 18° of rotation; illustrated on the sequence chart under the heating operation of FIG. 7. As can be seen, each fresh air, or outdoor, damper 61 is retained in the closed position and the return air damper 81 is retained in the closed position to prevent exhaust of air and to circulate all of the return air back to the building. The switch I, serving as the mode control means 23, is off during this time. It will be recalled that the mode control means may comprise either the light switch controlling the lights in the building or a clock controlled switch. As can be seen in the sequence chart, operation of most of the elements is prevented during this portion of the heating cycle, although the circulation blower 41 can be energized as needed for effecting circulation of the air. Similarly, the electric heaters 1, 2 and 3 can be turned on and off during this portion to supply heat to the air as needed to maintain the temperature set on the thermostat. The drive unit 115 position the motor 121 and the disc 123 to the desired degrees responsive to the voltage output from the thermostat 19. For example, if the voltage dropped from 7.5 as the midpoint voltage down toward 6.5 as the minimum voltage, the motor and disc 121 and 123 are rotated toward the 18° position, or the maximum at which the mode control means 23 will allow. As they roll through the first few degrees, the circulation blower is turned on followed by the electric heater No. 1. If this is adequate to supply enough heat, the thermostat will reflect the increased temperature and move back toward the 7.5° voltage. This is reflected by counterclockwise movement of the disc 123 to shut off the electric heater and subsequently the electric circulation blower 41. If inadequate, further degrees of rotation will turn on, successively, electric heaters 2 and 3 until adequate heating is being supplied. This modulation in the unoccupied mode continues until the mode control means 23 signals the beginning of the occupied mode.

When the light switch, switch I, is turned on, as at position 135, it effects the beginning of the occupied mode. As indicated hereinbefore, in the occupied mode, a mixture of return and fresh air is circulated. Specifically, the fresh air and return air dampers 61 and 81 are moved to their respective minimum fresh air positions and the circulation blower 41 is turned on. The relay is energized to free the disc 123 and allow rotation toward the position 137 which might be; for example, 32° of rotation. The return air damper is illustrated in the minimum fresh air position of FIG. 1. The fresh air dampers 61 will be opened to allow the minimum predetermined proportion of fresh air; for example, about 15 percent fresh air in the air being circulated. Thus, 15 percent of the return air is vented out the exhaust means 43. During the early morning hours, heat may be required so one or more of the electrical heaters may be turned on if the disc is stopped between positions 137 and 139. During the heating operation the electrical heaters may be modulated as desired by the clockwise and counterclockwise rotation of the disc 123 responsive to the control signal from the thermostat 19. As indicated hereinbefore, the determination of the type of conditioning needed, whether heating or cooling, is made automatically by the control means responsive to the signal from the thermostat 19. For example, if the thermostat signal falls below 7.5 volts, the heating cycle may be indicated, and the control means 50 modulates the heat input in accordance with needs reflected by the thermostat 19.

In the event that the temperature goes above the preset temperature such that cooling is indicated, a voltage higher than 7.5 volts will be emitted and the disc 123 is rotated toward the position 141 which may be; for example, 135°. As the disc is rotated clockwise; for example, past position 143 which may be; for example, 45°, the electric heater 3 is turned off followed successively by electric heater 2 at position 144 and electric heater 1 at position 145, the latter two positions may be; for example, 63° and 81°. Thus, all of the heaters are off by the time position 139 has been reached. At this position, corresponding to a predetermined proportion of fresh air and a corresponding first predetermined position of the return air damper, the exhaust fan 1 is turned on. This predetermined position may be in the range of 40–50 percent of the travel of the return air damper. The turning on of the first exhaust fan 77 serves to reduce the positive pressure effected in the building by the circulation blower 41. This reduction of the positive pressure interiorly of the building maintains the occupant comfort level; prevents movement of large surface areas, such as ceilings, glass areas and the like responsive to even small differential pressure thereacross; and is otherwise advantageous. As the return air damper 81 is moved toward the open position, the fresh air inlet dampers 61 are also moved concomitantly toward their respective open positions. The dampers are positioned so as to obtain the desired temperature.

As the dampers move toward the 100 percent open position, the second exhaust fan 79 (EF-2) will be turned on, indicated by position 147 which may be; for example, 125° of rotation, or the equivalent positioning of about 80–90 percent of the movement of the respective dampers, illustrated by the dashed line 149, FIG. 1. Energization of the second exhaust fan 79 serves the same salutary purpose as the energization of the first exhaust fan and allows excellent control of the positive pressure inside the building without wasting power or going below atmospheric pressure as has been done in the prior art with large exhaust fans. If further cooling is needed, the respective dampers go to their 100 percent open position in which all of the air being circulated in the building is fresh air coming in through the fresh air dampers 61 and being exhausted through the open return air damper 81. This allows maximum cooling when the outside air temperature is below the predetermined first temperature $T_1$. As indicated hereinbefore, the $T_1$ may be about 55°. During this time, if the thermostat 19 is satisfied; that is, the temperature will return to a preset temperature; the dampers will modulate in this range, moving anywhere from the minimum fresh air position to 100 percent fresh air position depending upon the requirements.

In the event that the outside temperature is less than $T_1$, indicated by the outside thermometer 151, FIG. 1, the disc is locked to prevent rotation past position 141 such that operation of the air cooling unit is prevented even if inadequate cooling is available. The reason for this is that the best that the conventional units can achieve in cooling is the minimum predetermined temperature $T_1$ such that there is no use in wasting power by having the mechanical air conditioning unit operating when the outside cooling will do as efficient a job of cooling. Thus, the unit may modulate the respective dampers to operate in this mode until a mode control means signals an unoccupied mode of operation.

In the event that the outside air temperature becomes greater than $T_1$, the lock point 141 is released by a signal from the outside thermometer, or outside thermostat, 151 by way of the controller 111. If the conditioned space inside the building still needs additional cooling, indicated by a high temperature on the thermostat 19, then the disc motor 121 continues to rotate the disc toward the 270° position. As the disc rotates past position 153, the second exhaust fan 79 is deenergized. The position 153 may be, for example, about 187° of rotation. Any further continued rotation will begin to move the dampers from their fully open position to the respective minimum fresh air position, indicated by the position 155 on the sequence chart of FIG. 7. If moved to the minimum fresh air position, the first exhaust fan 77 (E.F.–1) is also turned off. The position 155 may be, for example, about 220°. Thus, only the minimum fresh air is being admixed with the air being circulated in the building. Only a small additional clockwise movement turns on the air cooling unit 89, the compressor (COMP) and associated elements, such as the condenser fan, illustrated by position 157. At positions 157 and 159, the air cooling unit is turned on and off, respectively, to condition the air to the desired present temperature in accordance with signals from the thermostat 19. As described hereinbefore, the voltage signal drives the control means 50 to position the disc 123. Specifically, if the voltage signal effects a position between positions 157 and 159, the air cooling unit is operating to cool the air being circulated and the air being circulated will have only the minimum predetermined proportion of fresh air therein. As the thermostat signal moves back toward the 7.5 volts midpoint signal, the disc may be rotated to turn off the air cooling unit at position 159, for example, at about 225° of rotation. As the air temperature rises, the air cooling unit may be energized at position 157 which may be, for example, about 260° of rotation.

In the event that a cold front moves through and the temperature of the outside air drops below $T_1$, the unit is forced into the outside air cooling operation that has been described hereinbefore. Specifically, the disc 123 is caused to rotate back to position 141 and the dampers are modulated in the regions between 139 and 141 as described hereinbefore as long as cooling is required.

Eventually, the school day will end and the mode control means will signal a return to the unoccupied mode after the children or personnel have left the building 13 and the cycle repeats itself.

This invention employs conventional materials of construction, electrical and control elements, as noted, for economy. Equivalent items may be employed for those delineated, as can be seen from the following.

Any equivalents of linkages and the like can be employed. For example, gear combinations, hydraulic rams, gear and pinion combinations, or other equivalents can be employed for operating the dampers.

While the return air damper has been illustrated as a single blade damper, it may comprise a plurality of blades that are operable, respectively, responsive to the control means 50.

The motors employed to drive the respective elements (either explicit or implicit in the descriptive matter and drawings) may be single speed, two-speed, four speed or variable speed motors. They may drive the elements directly, as by shaft, or indirectly, as by gears, belt, or the like. Preferably, the motors have suitable safety controls, such as thermal overload protection, with or without automatic reset, the latter being preferred.

The exhaust means may include dampers, in addition to the return air damper, if desired for positive control.

The air circulation blower may comprise any suitable fan, pump or blower that is adapted to circulate the air through the building and may be disposed in any suitable position with respect to the evaporator coil and the heater, rather than in the preferred embodiment as illustrated in the figures.

While rectangularly shaped dampers have been described hereinbefore with respect to the fresh air dampers and the return air dampers, any other shape or shapes may be employed as long as the shape is compatible with the respective environment, such as the ducts and the fresh air inlet boxes.

Although an electrical heater having rows and columns of heating elements arranged in direct contact with the air being circulated has been described hereinbefore, any other heater may be employed. For example, gas fired heaters, oil fired heaters or heat pumps may be employed to heat the air to the desired temperature.

From the foregoing, it can be seen that this invention obviates the disadvantages of the prior art and provides a fresh air ventilating system that has the following features:

1. The ventilator unit 23 is disposed on a roof in a weather-proof cabinet so as to avoid taking up valuable classroom space or other space inside the building. This gives a better learning atmosphere; eliminates noise interiorly of the building; facilitates repair and maitenance without interruption of classroom time and use or expensive overtime after normal hours; and has other advantages.

2. The unit sits on the roof of the building on a sealing roof curb to obviate problems with sealing about expansible ducts for the return and the circulation air.

3. The fresh air inlet box is provided so as to get fresh air without precipitation and with out the unsightly, hoods, protuberances and the like that interfere with blending into a pleasing architectural scheme. This is particularly important when the building is in a lower area so that the roof is visible from elevated highways and the like.

4. The proportioning damper on at least the return air is provided to form a splitter that comprises a part of the exhaust means to minimize manufacturing costs and installation costs.

5. The system conserves power in the cooling operation by maximizing ambient cooling while employing two stage exhaust fans that conserve power and alleviate problems with too high or too low a pressure interiorly of the building as in the prior art.

Although this invention has been described with a certain degree of particularity, it is understood that the present disclosure has been made only by way of example and that numerous changes in the details of construction and the combination and arrangement of parts may be resorted to without departing from the spirit and the scope of this invention.

What is claimed is:

1. A fresh air ventilator system for a building or the like having a roof comprising:

a. a conditioned air plenum communicating interiorly of the building for distributing conditioned air therewithin;

b. a return air aperture communicating interiorly of said building for returning air from within said building;

c. a thermostat means disposed interiorly of said building for signalling the temperature with respect to a preset temperature;

d. a ventilator unit disposed on the roof of said building and connected with said conditioned air plenum and said return air aperture; said ventilator unit including:

i. a fresh air inlet adapted to admit fresh air and exclude precipitation; said fresh air inlet having fresh air damper means for controlling the quantity, from zero to maximum, of fresh air admitted;

ii. an air circulating blower connected at its discharge end with said conditioned air plenum and communicating at its suction end with said fresh air inlet and said return air aperture for circulating air within said building;

iii. an exhaust means for at least periodically exhausting a portion of return air; said exhaust means communicating exteriorly of said ventilation unit and said building and having a duct means for conveying said portion of said return air from said return air aperture to said exhaust means;

iv. a proportioning return air damper means disposed at said return air aperture for proportioning the amount of said return air, from zero to maximum, fed to said circulating blower; said proportioning damper means also coacting with said duct means to direct the remaining said return air to said exhaust means;

v. an air conditioning means for conditioning the air to be circulated into said building; said air conditioning means including:

a heater interposed in said ventilator unit in contact with said air being circulated by said circulating blower; and an air cooling unit disposed in said ventilator unit; said air cooling unit having the elements and sub-assemblies of:

I. compressor for compressing refrigerant gas;

II. condenser connected with the discharge of said compressor for condensing to a liquid the compressed refrigerant gas;

III. evaporator connected in fluid communication with said condenser for evaporating the condensed liquid refrigerant and simultaneously removing heat from said air being circulated by said evaporator; said evaporator being connected with said compressor for conveying the refrigerant gas thereto to repeat the cycle; said evaporator being interposed in said ventilator unit in contact with said air being circulated by said circulating blower;

IV. condenser air flow passageway encompassing said condenser for conveying ambient air therepast to remove heat therefrom; and V. a condenser fan disposed in said conditioned air flow passageway so as to blow ambient air past said condenser to remove the heat from the compressed refrigerant gas being flowed through said condenser; and vi. control means for controlling operation of said blower, said heater and said air cooling unit; said control means being responsively connected with said thermostat and drivingly connected with said blower, said heater and said air cooling unit;

said control means including a controller for determining the type of air conditioning necessary and a damper positioning means for positioning said damper means in accordance with a mode and type of air conditioning necessary;

said exhaust means including a plurality of motor-driven exhaust fans that are selectively and individually operable for economy and for minimizing pressurization of said building; and a mode control means is operably connected to effect operation of said ventilator unit in one of two modes; a first said mode being designated an unoccupied mode in which said damper positioner means positions said damper means closed to effect full circulation of said return air with no exhaust of return air and no admission of fresh air and with said air conditioning means being responsively connected with said thermostat to control the temperature of the air being circulated within said building; a second said mode being designated an occupied mode in which said controller is operably connected to effect operation in one of an air-heating operation and an air-cooling operation with said damper positioner means positioning said damper means into a first position sufficient to admit at least a first predetermined proportion of fresh air with respect to said air being circulated and exhaust said first predetermined proportion of return air; said heater being at least periodically responsively connected with said thermostat in said heating operation and said air-cooling unit being at least periodically responsively connected with said thermostat in said cooling operation.

2. The fresh air ventilator system of claim 1 wherein said fresh air inlet comprises a fresh air inlet box having a chamber into which incoming air initially flows; said chamber being adapted to trap out precipitation; said chamber having a drain to drain liquid exteriorly of said ventilation unit; said chamber having said fresh air damper means communicating intermediate said chamber and said circulating blower.

3. The fresh air ventilator system of claim 2 wherein said fresh air damper means includes a fresh air damper disposed at the upper portion of said chamber and said chamber has vanes and a screen for preventing entry into said building of precipitation and insects; said chamber having an elongate configuration and being adapted to be integrated into said ventilator unit and conforming to linear external lines of said ventilator unit for architecturally pleasing profiles and appearances.

4. The fresh air ventilator system of claim 3 wherein said ventilator unit has a rectangular cross sectional shape and includes a plurality of said fresh air inlet boxes disposed one on each side and adjacent said exhaust means and fluidly isolated therefrom interiorly of said ventilator unit.

5. The fresh air ventilator system of claim 3 wherein said condenser air flow passageway is disposed at the end of said ventilator unit opposite from said fresh air inlet so as to minimize flow of heated air from said condenser into said fresh air inlet.

6. The fresh air ventilator system of claim 5 wherein said condenser air flow passageway and said condenser fan have an upwardly directed discharge so as to direct said hearted air from said condenser upwardly.

7. The fresh air ventilator system of claim 1 wherein a type cooling control means is operably connected with said control means; said type cooling control means being operable into one of an outside air cooling operation and a heat removal operation; in said outside air cooling air operation said damper positioning means being responsively connected with said thermostat so as to position said damper means as necessary to maintain said preset temperature on said thermostat; a first said exhaust fan being connected with said control means so as to be energized at a first predetermined position of said return air damper means; a second said exhaust fan being connected with said control means so as to be energized at a second predetermined position of said return air damper means; in said heat removal operation said damper positioning means being operably connected to move said damper means to said first position, said exhaust fans being shut off and said air cooling unit being at least periodically responsively connected with said thermostat so as to maintain said preset temperature with said first predetermined proportion of fresh air being circulated.

8. A method of operating a fresh air ventilator system for air conditioning a building, comprising the steps of:

a. operating in one of an unoccupied mode and an occupied mode; at least semi-automatically determining which mode in which to operate; and remaining in that mode during operation until a determination is at least semi-automatically made to operate in the other mode;

b. in said unoccupied mode:

i. circulating return air as needed in said building;
ii. conditioning the air being circulated as needed;
iii. at least semi-automatically determining that the occupied mode is to be entered into;

c. in the occupied mode:
i. circulating a mixture of return and fresh air;
ii. automatically determining the type of conditioning to be employed and employing one of a heating operation and a cooling operation;

I. in said heating operation, when determined to be necessary, adding heat as needed until a determination is made that the unoccupied mode is to be employed;

II. in said cooling operation, when determined to be necessary:

A. circulating outside air as needed to obtain the preset temperature; up to the maximum in which all of the air being circulated is fresh air;

B. at a first predetermined proportion of the air being circulated being fresh air, energize a first exhaust fan;

C. at a second predetermined proportion of the air being circulated being fresh air, energize a second exhaust fan serially and in addition to said first exhaust fan;

D. operating with an indicated proportion of outside air to maintain the desired temperature as long as the outside air is below a first predetermined temperature;

E. upon the occurrence of a temperature in the building higher than the preset temperature and the temperature of the outside air rising above said first predetermined temperature, entering upon a heat removal operation as follows:
1. circulating the minimum allowable proportion of fresh air while exhausting the minimum proportion of return air; and
2. energizing the auxiliary cooling to remove heat from the air being circulated to maintain said preset temperature;

F. upon the occurence of outside air dropping below the first predetermined temperature, returning to outside air cooling in accordance with steps A–D; and G. at least semi-automatically determining that the unoccupied mode is to be entered into, terminating the cooling operation and entering into the unoccupied mode.

* * * * *